United States Patent [19]

Yoshino

[11] Patent Number: 4,937,515

[45] Date of Patent: Jun. 26, 1990

[54] LOW SUPPLY VOLTAGE CURRENT MIRROR CIRCUIT

[75] Inventor: Hiroshi Yoshino, Yokohama, Japan

[73] Assignee: Kabushiki Kaisha Toshiba, Kawasaki, Japan

[21] Appl. No.: 401,230

[22] Filed: Aug. 31, 1989

[30] Foreign Application Priority Data

Aug. 29, 1988 [JP] Japan ..... 63-214166

[51] Int. Cl.[5] ..... G05F 3/26

[52] U.S. Cl. ..... 323/315; 330/257; 330/288

[58] Field of Search ..... 323/315, 316; 330/257, 330/288

[56] References Cited

U.S. PATENT DOCUMENTS 4,329,639 5/1982 Davis ..... 323/315
4,563,632 1/1986 Palara et al. ..... 323/316

FOREIGN PATENT DOCUMENTS 38821 3/1984 Japan ..... 323/315
208618 11/1984 Japan ..... 323/316
117019 5/1987 Japan .

*Primary Examiner*—William H. Beha, Jr.
*Attorney, Agent, or Firm*—Finnegan, Henderson, Farabow, Garrett and Dunner

[57] ABSTRACT

The current mirror circuit comprises a feedback transistor whose emitter and collector are connected between the collector and base of the input transistor. The base of the feedback transistor is grounded. Due to the presence of the feedback transistor, the potential at the collector of the input transistor can be set at a potential which is lowered from the Vcc potential by a saturation voltage between the emitter and collector of the input transistor.

4 Claims, 5 Drawing Sheets

LOW SUPPLY VOLTAGE CURRENT MIRROR CIRCUIT

BACKGROUND OF THE INVENTION

Field of the Invention

The present invention relates to a current mirror circuit which can be operated at a low voltage. FIG. 1 is a circuit diagram showing a conventional current mirror circuit constituted of PNP transistors. In FIG. 1, reference numeral 71 denotes an input transistor whose base-collector path is short-circuited, and reference numerals 72 and 73 indicate output transistors the bases of which are connected to that of transistor 71. The collector of transistor 71 is connected to input current source 74, and the collectors of transistors 72 and 73 each output current Iout which is proportionate to a current flowing into input current source 74.

In the conventional current mirror circuit, a voltage obtained by subtracting voltage VBE between the base and emitter of transistor 71 from power supply voltage Vcc is applied to input current source 74 as an operating voltage. Let us consider that a low voltage of 0.9 V is applied to the input current source as power supply voltage Vcc. If voltage VBE between the base and emitter of transistor 71 is 0.7 V, the operating voltage applied to input current source 74, has a low value of 0.2 V. The current mirror is thus limited in its application field. This problem will be explained, referring to a differential amplifier circuit illustrated in FIG. 2.

FIG. 2 is a circuit diagram showing a differential amplifier circuit which can be operated at a low voltage. The differential amplifier circuit includes two conventional current mirror circuits, as shown in FIG. 1. One of the current mirror circuits is indicated by reference numeral 81 and constituted of transistors 82 and 83, and the other current mirror circuit is represented by numeral 84 and constituted of transistors 85 and 86. While the current mirror circuit shown in FIG. 1 comprises two output transistors, the current mirror circuits shown in FIG. 2 each comprises a single output transistor. An input current source (corresponding to input current source 74 in the circuit shown in FIG. 1) which supplies an input current to current mirror circuits 81 and 84, consists of differential amplifier 91 including differential pair 89 of NPN transistors 87 and 88 and constant current source 90 connected to a common emitter of differential pair 89. The collector currents of transistors 87 and 88 included in differential amplifier 91 which is supplied with differential input signal Vin, are supplied to current mirror circuits 81 and 84, respectively.

Let us think about a case where the differential amplifier circuit shown in FIG. 2 is operated at a power voltage of 0.9 V. If voltage VBE between the base and emitter of transistor 82 or 85 is 0.7 V, differential amplifier 91 is applied with a voltage of only 0.2 V. Since a saturation voltage (V CEsat) of 0.15 V needs to be secured as a voltage between the collector and emitter of transistor 87 or 88, the operating voltage of constant current source 90 is 0.05 V at the most and, in other words, there is no operating voltage enough to operate constant current source 90. Though constant current source 90 may be constituted of a resistor, its resistance must be sufficiently lowered in order to ensure a considerably large current. Some problems, such as a problem wherein the gain of differential pair 89 decreases and the bias current varies according to the base voltage bias condition of differential pair 89, will then arise. Constant current source 90 can thus be constituted of a transistor whose emitter is grounded, in which case, the lowest voltage Vccmin of power supply voltage Vcc is given by the following equation:

$$Vccmin = VBE + 2\ VCEsat = 0.7 + 2 \times 0.15 = 1\ (V).$$

As is apparent from the equation, the constant current source does not operate when power supply voltage Vcc is lowered below 1 V.

As mentioned above, the conventional current mirror circuit has the drawback wherein the base-collector path of the input transistor is short-circuited so that a voltage supplied to the input current source is lowered and thus the application field of the current mirror circuit is limited.

SUMMARY OF THE INVENTION

The present invention has been made in consideration of the above situation and has as its object to provide a current mirror circuit in which the operation voltage of an input current source circuit is higher than that in a conventional circuit so that the current mirror circuit can be applied to various fields.

The current mirror circuit according to the present invention comprises a first transistor whose emitter is connected to a first potential, a second transistor whose emitter and collector are connected between the collector and base of the first transistor and whose base is grounded, an input current source circuit connected between the collector of the first transistor and a second potential, a constant current source connected between the base of the first transistor and the second potential, and a third transistor whose emitter is connected to the first potential and whose base is connected to the base of the first transistor.

Since the emitter and collector of the second transistor, the base of which is grounded, are inserted between the collector and emitter of the first transistor serving as an input transistor of the current mirror circuit, the potential at the collector of the first transistor can be set at a potential which is lowered from the first potential by a saturation voltage between the emitter and collector of the first transistor. In this circuit arrangement, therefore, the constant current source is connected between the base of the first transistor and the second potential to operate the second transistor.

DETAILED DESCRIPTION OF THE PREFERRED EMBODIMENTS

Figure 3:
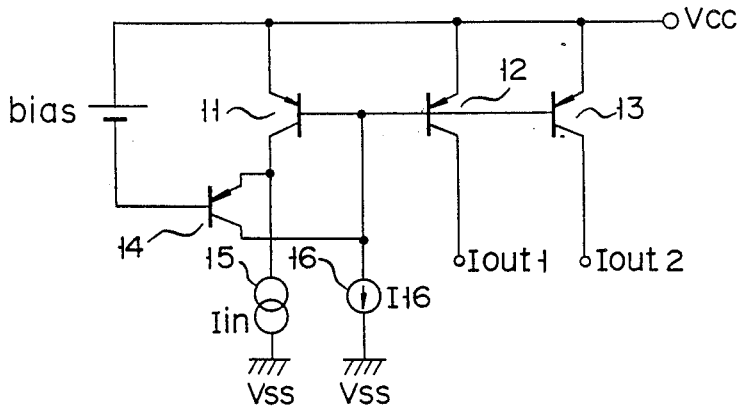
FIG. 3 is a circuit diagram showing a current mirror according to an embodiment of the present invention.

The embodiments of the present invention will be described with reference to the accompanying drawings. FIG. 3 is a circuit diagram showing a current mirror circuit according to an embodiment of the present invention. In FIG. 3, PNP transistor 11 is an input transistor, and two PNP transistors 12 and 13 are output transistors. The emitters of the three transistors are each connected in parallel to power supply Vcc of positive polarity and the bases thereof are connected in common to each other. The emitter of PNP transistor 14 is connected to the collector of transistor 11. The base of transistor 14 is connected to power supply Vcc through DC bias Vbias and grounded. The collector of transistor 14 is connected to the common base of transistors 11, 12 and 13. Input current source 15 of current Iin is connected between the collector of transistor 11 and ground Vss. Constant current source 16 of current I16 is connected between the common base of transistors 11, 12 and 13 and ground Vss. The collectors of transistors 12 and 13 serving as output transistors output current Iout1 and Iout2, respectively.

In the circuit according to this embodiment, a feedback circuit is formed between the collector and emitter of transistor 11 by transistor 14 whose base is grounded. The collector potential at transistor 11 can be thus set at a value obtained by subtracting saturation voltage VCEsat between the emitter and collector of transistor 11 from power source voltage Vcc. When a low voltage of 0.9 V is applied to the circuit as power source voltage Vcc and saturation voltage VCEsat between the emitter and collector of transistor 11 is set at 0.15 V, the operating voltage applied to input current source 15 is 0.75 V which is much higher than the operating voltage (0.15 V) of the conventional circuit. Consequently, various types of elements can be used for input current source 15 and accordingly the application field of the current mirror circuit can be widened.

The circuit illustrated in FIG. 3 includes constant current source 16 for operating transistor 14 and output currents Iout1 and Iout2 increase by current I16 of constant current source 16. When the sizes of transistors 11–13 are so determined that a current mirror ratio is "1," output currents Iout1 and Iout 2 are given by the following equation:

$$Iout1 = Iout2 = Iin + I16.$$

Figure 4:
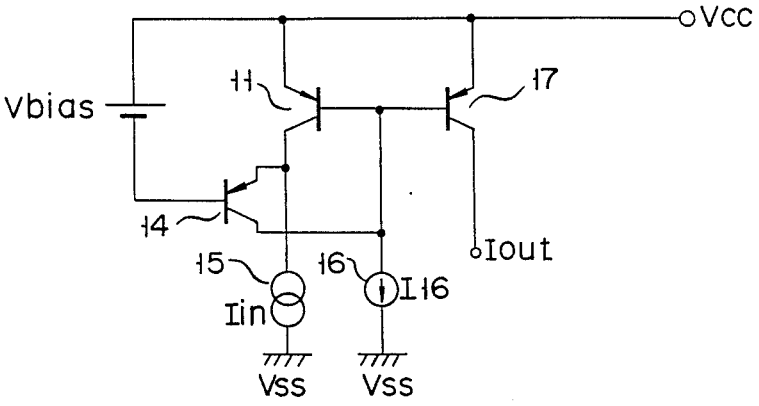
FIG. 4 is a circuit diagram showing a modification of the current mirror circuit shown in FIG. 3.

In the embodiment shown in FIG. 3, two output transistors are provided. As shown in FIG. 4, however, it is only necessary to provide one transistor indicated by reference numeral "17". In the embodiment shown in FIG. 3, too, output current Iout is represented by the following equation:

$$Iout = Iin + I16.$$

An applied example of the present invention will be described with reference to FIG. 5.

Figure 2:
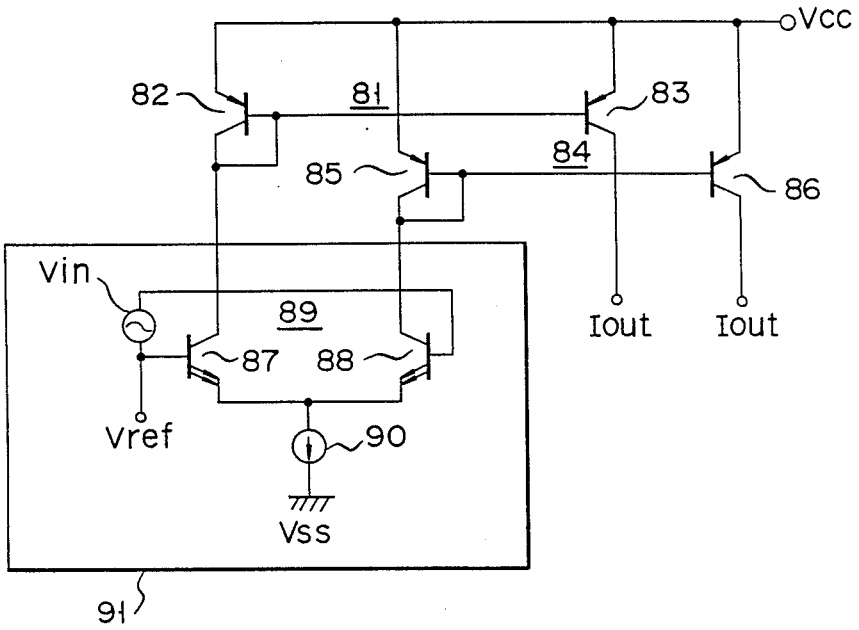
FIG. 2 PRIOR ART
FIG. 2 is a circuit diagram showing a conventional differential amplifier circuit using the current mirror shown in FIG. 1.
Figure 5:
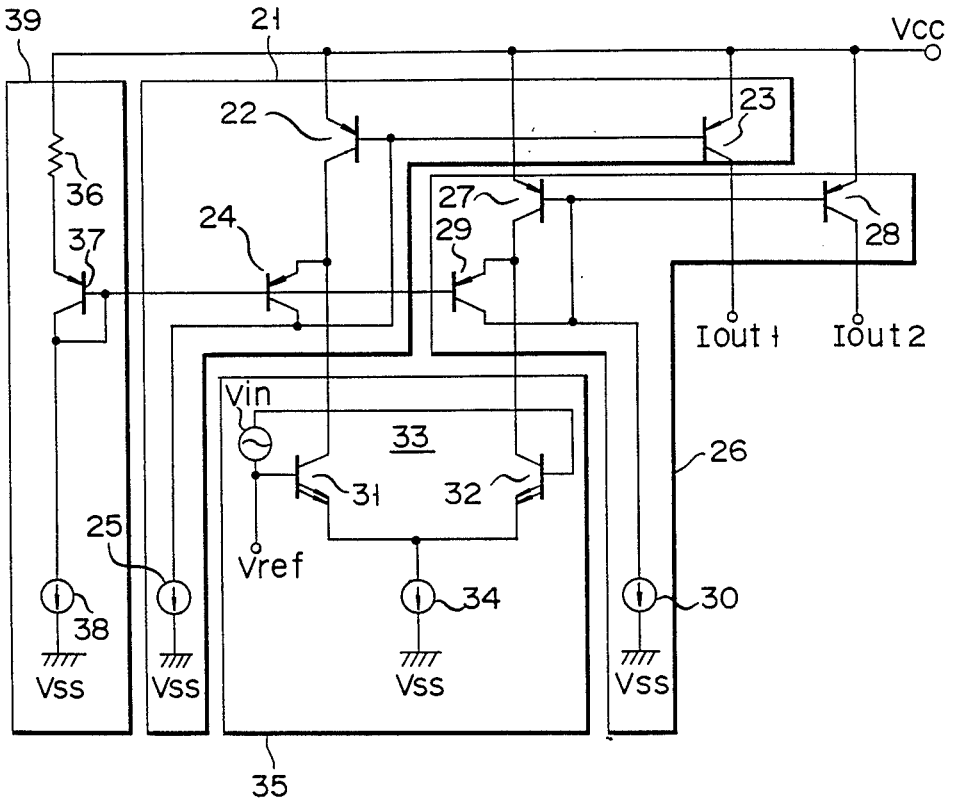
FIG. 5 is a circuit diagram showing a differential amplifier circuit using the modified current mirror circuit shown in FIG. 4.

FIG. 5 is a circuit diagram showing a differential amplifier circuit using the current mirror circuit according to the embodiment shown in FIG. 4. The differential amplifier circuit includes two current mirror circuits, like the conventional differential amplifier circuit shown in FIG. 2. One of the current mirror circuits 21 comprises input PNP transistor 22, output PNP transistor 23, feedback PNP transistor 24 and constant current source 25 for operating feedback transistor 24. The other current mirror circuit 26 includes input PNP transistor 27, output PNP transistor 28, feed-back PNP transistor 29 and constant current source 30 for operating feedback transistor 29. A current source (corresponding to input current source 15 shown in FIG. 4) for supplying an input current to current mirror circuits 21 and 26 is constituted of differential amplifier 35 including differential pair 33 of a pair of NPN transistors 31 and 32 and constant current source 34 connected to a common emitter of differential pair 33. Current mirror circuits 21 and 26 are supplied with collector currents of transistors 31 and 32 in differential amplifier 35 which receives differential input signal Vin.

DC bias Vbias is constituted of DC bias voltage generator circuit 39 including resistor 36, PNP transistor 37 and constant current source 38. Differential pair transistors 31 and 32 complementarily turn on and off in response to input signal Vin.

When each of transistors 31 and 32 turns on, a current flows through a circuit including the transistor. More specifically, when transistor 31 turns on, a current flows through a circuit including transistors 22 and 31 and a current flows through a circuit including transistors 22 and 24. The sum Iout1 of these currents flow through output transistor 23. When transistor 32 turns on, a current flows through a circuit including transistors 27 and 32 and a current flows through a circuit including transistors 27 and 29. The sum Iout2 of these currents flow through output transistor 28.

Resistor 36, transistor 37 and current source 38 are connected in series between power supply Vcc and ground Vss serving as a reference potential. The base of transistor 37 is connected to that of feedback transistor 24 of current mirror circuit 21 and to that of feedback transistor 29 of current mirror circuit 26. The bases of these feedback transistors are supplied with DC bias Vbias.

Figure 6:
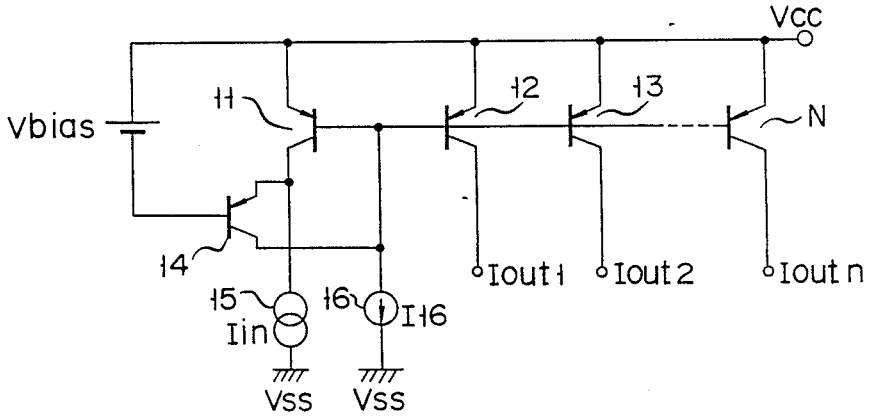
FIG. 6 is a circuit diagram showing another modification of the current mirror circuit shown in FIG. 3.

FIG. 6 is a circuit diagram showing a modification of the current mirror circuit illustrated in FIG. 3. In the circuit shown in FIG. 6, N output transistors are provided, and current Ioutn (n=1, 2, . . . ) flows through the output terminals of the output transistors.

Figure 7:
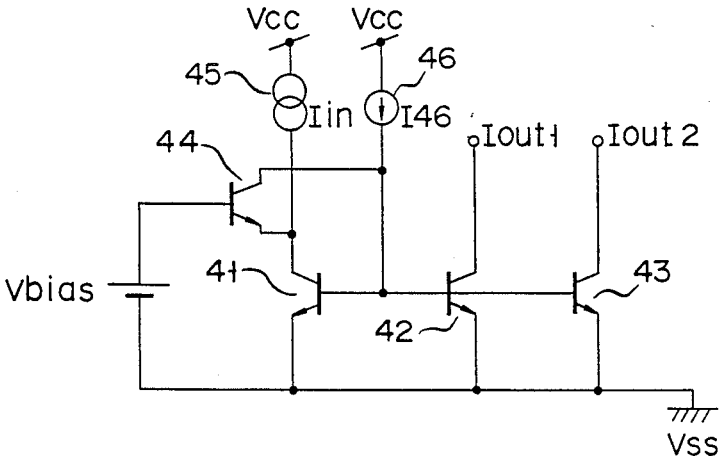
FIG. 7 is a circuit diagram showing a current mirror circuit according to another embodiment of the present invention.

FIG. 7 is a circuit diagram showing a current mirror circuit according to another embodiment of the present invention. This current mirror circuit is constituted of NPN transistors. In FIG. 7, NPN transistor 41 is an input transistor and NPN transistors 42 and 43 are output transistors. The emitters of these three transistors are connected in parallel to ground Vss of negative polarity, and the bases thereof are connected in common to one another. The emitter of NPN transistor 44 is connected to the collector of transistor 41. The base of transistor 44 is connected to ground Vss through DC bias Vbias and the collector thereof is connected to a common base of transistors 41, 42 and 43. Further, input current source 45 of current Iin is connected between collector of transistor 41 and power supply Vcc, and constant current source 46 of current I46 is connected between the common base of transistors 41, 42 and 43 and ground Vss. Output currents Iout1 and Iout2 are supplied from the collectors of transistors 42 and 42, respectively.

In the circuit according to the embodiment shown in FIG. 7, like in the circuit shown in FIG. 3, a feedback circuit is formed between the emitter and collector of transistor 41 by transistor 44 whose base is grounded. The voltage between the emitter and collector of transistor 41 can be set at a value which is higher than ground voltage Vss by saturation voltage V CEsat. Consequently, a low voltage of, e.g., 0.9 V is applied as power source voltage Vcc. If the saturation voltage (V CEsat) between the emitter and collector of transistor 41 is set at 0.15 V, an operating voltage applied to input current source 15 is 0.75 V, which is considerably higher than the operation voltage of 0.2 V of the conventional circuit. Therefore, various types can be used for input current source 45 and the application field of the current mirror circuit can be widened.

Figure 8:
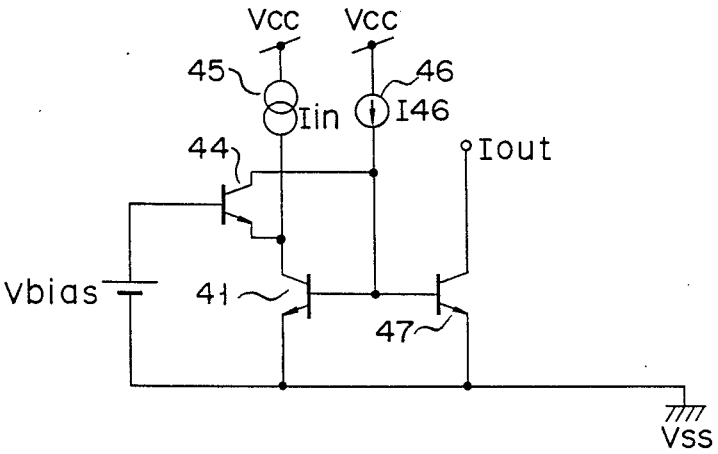
FIG. 8 is a circuit diagram showing a modification of the current mirror circuit shown in FIG. 7.

Two output transistors are provided in the embodiment shown in FIG. 7. As shown in FIG. 8, however, a single transistor represented by numeral 47 can be provided. In this embodiment, too, output current Iout is given by the following equation:

$$Iout = Iin + I46.$$

Figure 9:
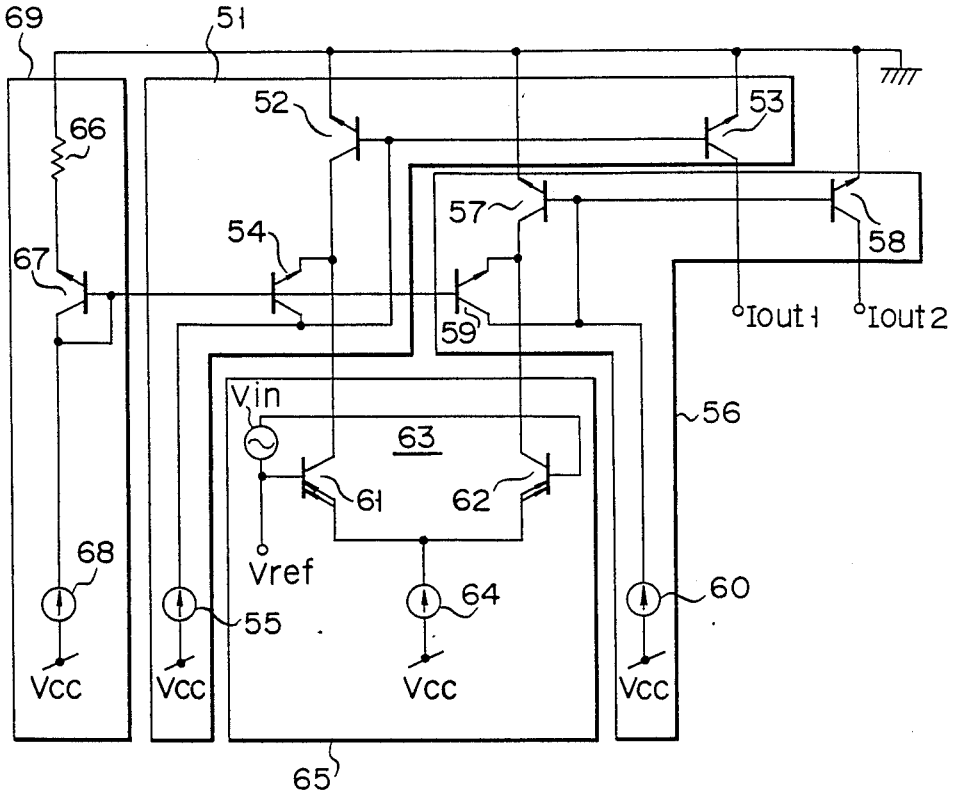
FIG. 9 is a circuit diagram showing a differential amplifier circuit using the modified current mirror circuit shown in FIG. 8.

FIG. 9 is a circuit diagram showing a differential amplifier circuit using the circuit according to the embodiment shown in FIG. 8. Since the operation of the differential amplifier circuit is identical with that of the differential amplifier circuit shown in FIG. 5, it is omitted.

Figure 1:
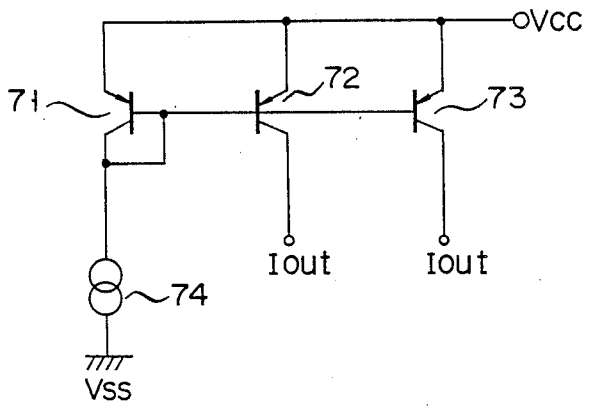
FIG. 1 PRIOR ART
FIG. 1 is a circuit diagram showing a conventional current mirror.
Figure 10:
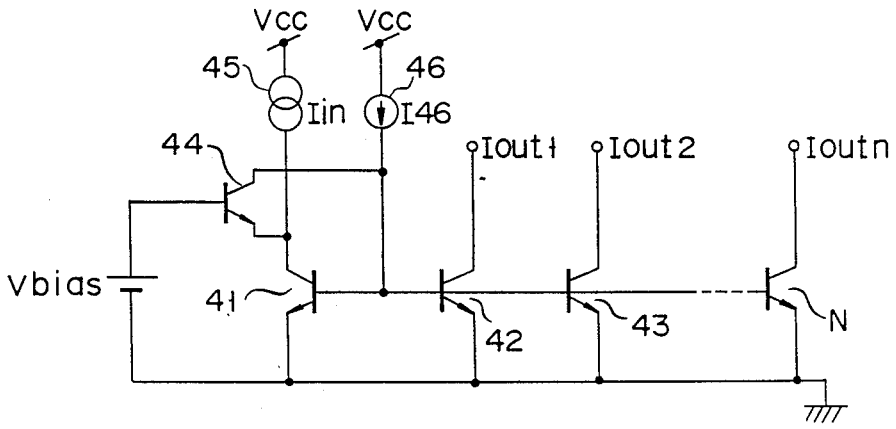
FIG. 10 is a circuit diagram showing another modification of the current mirror circuit shown in FIG. 7.

FIG. 10 is a circuit diagram showing a modification of the current mirror circuit shown in FIG. 1. In the circuit shown in FIG. 10, N output transistors are provided, and current Ioutn (n=1, 2, . . . ) flows through the output terminals of the transistors.

As described above, since a feedback loop is formed between the collector and emitter of an input transistor by a transistor whose base is grounded, the collector potential of the input transistor is higher than that of an input transistor of the conventional circuit and accordingly the operation voltage applied to an input current source is enhanced. The application field of the current mirror circuit can thus be widened.

What is claimed is:

1. A current mirror circuit comprising:

a first transistor whose emitter is connected to a first potential;

a second transistor whose emitter and collector are inserted between the collector and base of said first transistor and whose base is grounded;

an input current source circuit which is grounded between the collector of said first transistor and a second potential;

a constant current source connected between the base of said first transistor and the second potential; and a third transistor whose emitter is connected to the first potential and whose base is connected to the base of said first transistor.

2. A current mirror circuit according to claim 1, in which said first to third transistors are of pnp type.

3. A current mirror circuit according to claim 1, in which said first to third transistors are of npn type.

4. A current mirror circuit according to claim 1, in which said first transistor is an input transistor and said third transistor is an output transistor.

* * * * *

UNITED STATES PATENT AND TRADEMARK OFFICE

CERTIFICATE OF CORRECTION

PATENT NO. : 4,937,515

DATED : June 26, 1990

INVENTOR(S) : Hiroshi Yoshino

It is certified that error appears in the above-identified patent and that said Letters Patent is hereby corrected as shown below:

On the title page, please delete the following:

--[30] Foreign Application Priority Data
Aug. 29, 1988 [JP] .....63-214166--.

Signed and Sealed this

Thirteenth Day of April, 1993

*Attest:*

STEPHEN G. KUNIN

*Attesting Officer*

*Acting Commissioner of Patents and Trademarks*